US006036400A

United States Patent [19]

Clark

[11] Patent Number: 6,036,400

[45] Date of Patent: Mar. 14, 2000

[54] QUICK RELEASE DELINEATOR APPARATUS

[75] Inventor: Richard O. Clark, Austin, Tex.

[73] Assignee: Flexco, Austin, Tex.

[21] Appl. No.: 09/233,836

[22] Filed: Jan. 20, 1999

Related U.S. Application Data

[60] Provisional application No. 60/072,194, Jan. 22, 1998.

[51] Int. Cl.[7] ..... E01F 9/012; E01F 9/013

[52] U.S. Cl. ..... 404/9; 404/13; 116/63 P; 40/608

[58] Field of Search ..... 404/9, 10, 12, 404/13; 116/63 R, 63 P; 40/607, 608, 612

[56] References Cited

U.S. PATENT DOCUMENTS 5,199,814 4/1993 Clark et al. ..... 404/10

*Primary Examiner*—James A. Lisehora
*Attorney, Agent, or Firm*—Jackson Walker, L.L.P.

[57] ABSTRACT

An impact recovery delineation quick connect/disconnect adapter system having plate studs and a pin that when added to the impact recovery delineation system allows the delineation panel, support post and load cell to be quickly connected to and/or disconnected from the supporting base (fixed or portable) with speed and without the use of any tools. The adapter plate which is connected to the load cell provides for radially aligned slots in a recessed platform to allow the plate to engage and lock with studs that are connected to the supporting base when the load cell is rotated about its vertical axis. The studs are particularly geometrically configured and have shoulder that is larger than the barrel and a head that is larger than the shoulder which results in a mechanical locking between the plate slots and the studs upon rotation of the plate with respect to the stationary studs. A quick release detent pin passes through aligned passages in the lower load cell element adapter plate and supporting base to prevent rotation of the load cell with respect to the horizontal axis of the base after connection is achieved. This provides a positive connection that is capable of withstanding multiple high speed impact by automobile vehicles without disengaging.

6 Claims, 5 Drawing Sheets

QUICK RELEASE DELINEATOR APPARATUS

This application claims the benefit of U.S. Provisional Application Ser. No. 60/072,194, filed Jan. 22, 1998.

BACKGROUND OF THE INVENTION

The present invention relates to highway delineator systems; and more particularly to an apparatus for rapid, easy connecting and disconnecting of the delineator post from the base (whether fixed or portable).

U.S. Pat. No. 4,806,046 and U.S. Pat. No. 5,199,814 disclose art relating to an impact recovery delineation system that uses threaded connectors to rigidly connect the load cell assembly to the support base (fixed base and/or portable base). However, certain features still exist with the existing system, and specifically those taught in U.S. Pat. No. 5,199,814 which the present invention seeks to improve.

Delineator posts and delineation panels used to mark travel ways and to identify the existence of hazardous objects are often impacted by vehicles and damaged thereby requiring replacement. It is also desirable to use delineation on a frequent and temporary basis while allowing the base support to remain permanently located. Separation of the base support and delineation post and signage panel is also desirable for more convenient transporting and storage of the delineation systems. The use of threaded connectors to attach the load cell to the base support is labor time consuming, awkward and requires the use of tools. The removal of the connectors with the use of tools is often performed by workers under traffic conditions and this exposure can be very dangerous to the worker.

Consequently, it is desirable to provide a means to quickly connect and disconnect the load cell with delineator post and delineation panel from the support base and still provide a rigid connection that will withstand multiple, high speed impact forces when struck by an automobile vehicle.

The improvements of the present system allow for the load cell to be connected to the support base (fixed base or portable base) quickly by engaging studs (having a head larger than the shoulder) into a slotted, recessed platform by a rotational action of the load cell about its vertical axis. This may be accomplished without the use of any tools. A quick release detent pin or pins may be passed through aligned passages in the lower load cell element adapter plate and supporting base to prevent rotation of the load cell about its vertical axis with respect to the horizontal axis of the base. The load cell is quickly disconnected from the support base by pulling the quick release detent pin(s) from the aligned passage in the support base adapter plate and lower load cell element and counter rotating the load cell about its vertical axis with respect to the horizontal axis of the support base, thereby disengaging the slotted recessed platform from the stationary studs. The post and affixed signage may be thereafter separated.

SUMMARY OF THE INVENTION

The present invention provides an impact recovery delineation quick connect/disconnect adapter system that is capable of connecting the load cell having a delineator post and delineation panel to the base support without the use of any tools thereby minimizing the time required to perform such functions.

The present invention provides a novel adapter plate that can be connected to the lower load cell element without modification to the load cell thereby allowing the load cell to be used with its conventional threaded connection to be base support.

This invention further provides novel studs that are attached to the base support (fixed and portable) which enable the load cell with adapter plate to be connected to the base support without the use of tools but rather by a rotational action between the two members.

The invention also incorporates a quick release detent pin that prevents counter rotation of the load cell about its vertical axis to insure the load cell and base support are not unintentionally disconnected.

The invention provides for a rigid connection between the load cell and base support that will withstand multiple, high speed impacts from automobile vehicles.

DETAILED DESCRIPTION OF THE PREFERRED EMBODIMENT

Figure 1:
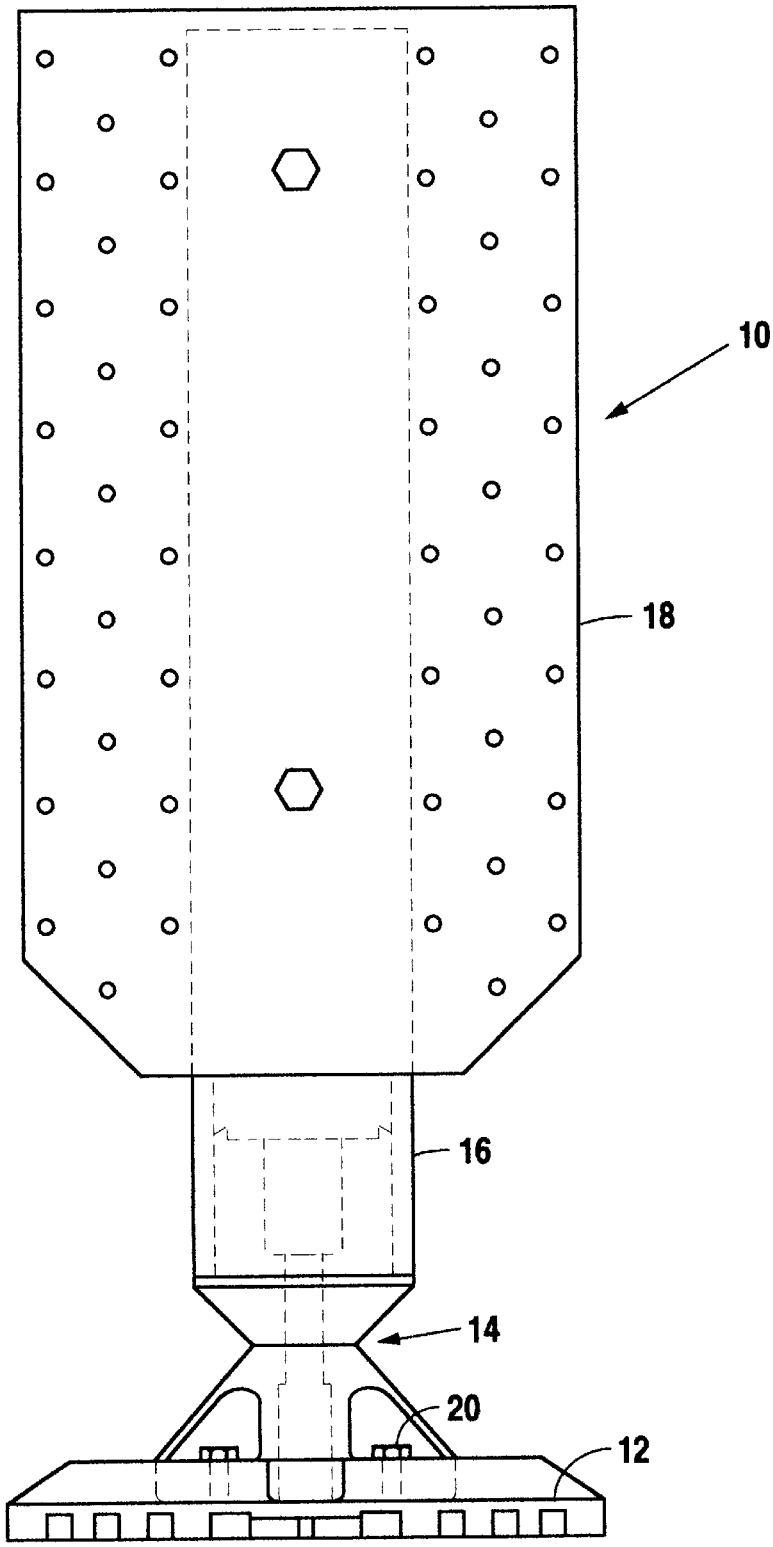
Fig. 1 (PRIOR ART)
FIG. 1 is a side elevational view of the prior art.

Referring now to the drawings and first to FIG. 1, an impact recovery delineator system of the prior art is illustrated generally at 10 and incorporates a base 12, a load cell assembly 14, and a delineator post 16. The post is provided with a reflective signage panel 18.

The signage 18, post 16, and load cell assembly 14 are securely attached to the base 12 by common bolting fasteners 20. In order to remove the post 16, generally four fasteners must be removed. Often the fasteners have become rusted, dirty or otherwise degraded, making removal difficult and time-consuming even with specialized tools.

Figure 2:
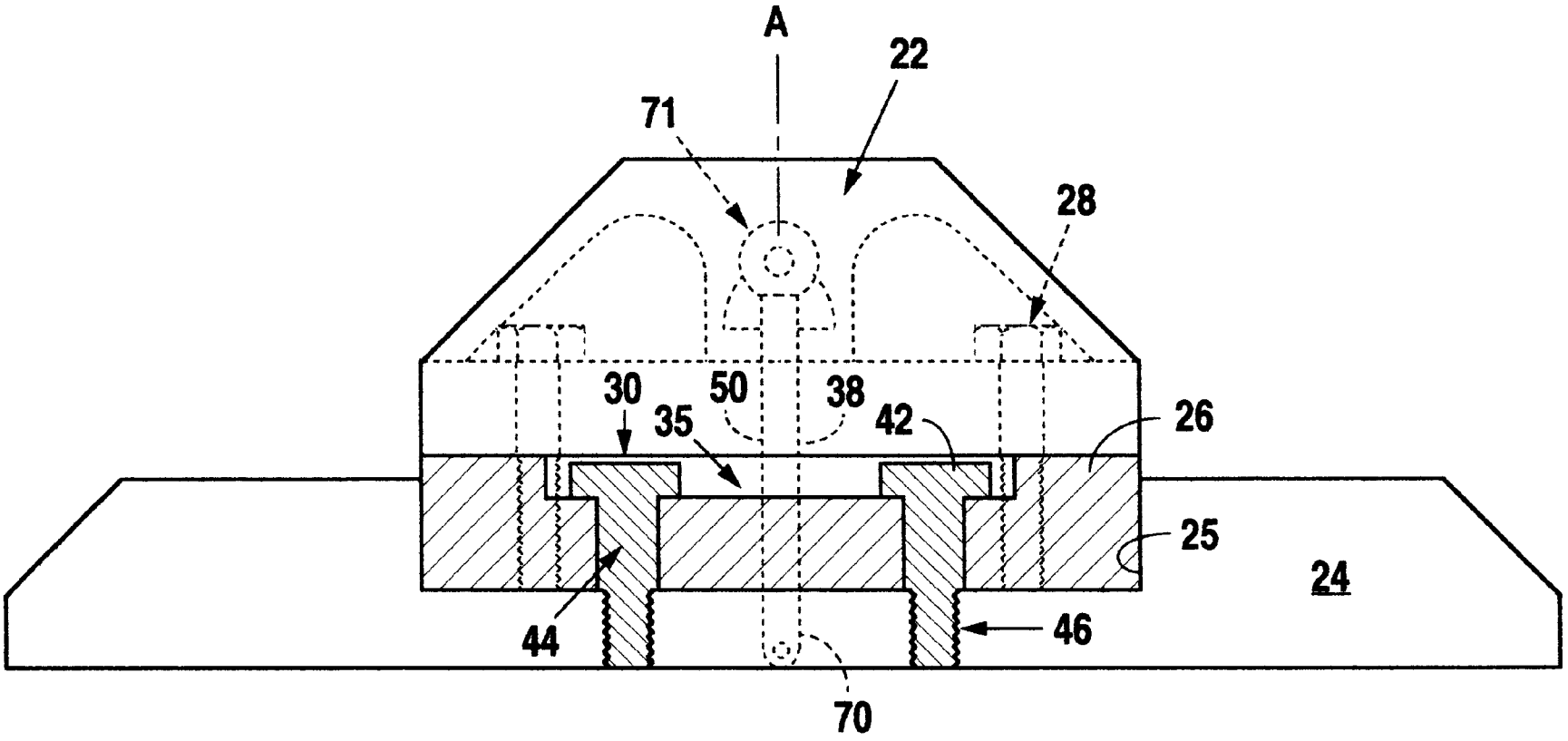
FIG. 2 is a cross-sectional view of the present invention.

FIG. 2 illustrates a side elevational cross-section view of the present invention showing the structural relationship of a load cell assembly 22 and a base 24 with the adapter plate 26 of the present invention. Plate 26 is attached to the load cell assembly by bolts 28 which are threadingly secured through the load cell to the plate 26. The plate 26 is detachably affixed to base 24 by plate studs 30 which are fastened securely to base 24 by threaded ends 46.

Plate 26 is provided with radially aligned slots or openings 34 (FIG. 3) in recessed platform 35. Slots 34 receive plate studs 30 in rotating engagement as will be discussed below. Stud heads 42 hold the plate 26 in engagement with the base 24 when the load cell assembly 22 is rotated about its vertical axis A (FIG. 2).

Figure 3:
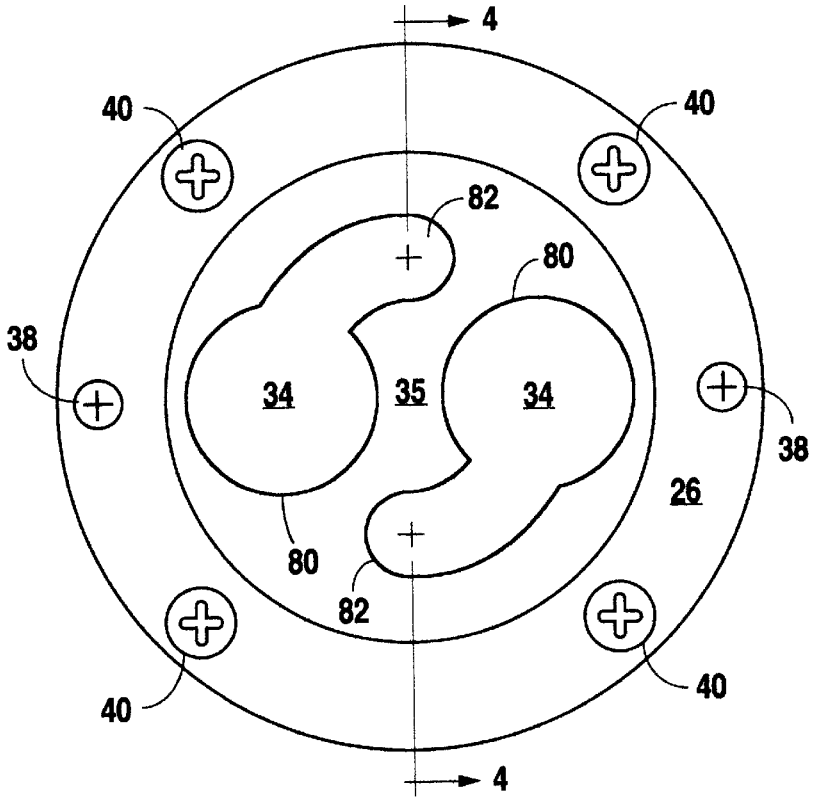
FIG. 3 is a top view of the adapter plate of the present invention.

FIG. 3 shows the adapter plate 26 in a top plan view. Recessed platform 35 contains the radially aligned slots 34 and allows the stud head 42 sufficient clearance for rotation. Along the perimeter of the plate 26 are a number of openings. Detent passages 38 are intended to accept detent pins 71 when the delineator system is properly assembled. Threaded openings 40 are for receiving suitable threaded fasteners 28 (FIG. 2) to secure the plate 26 to the load cell assembly 22.

Figure 4:
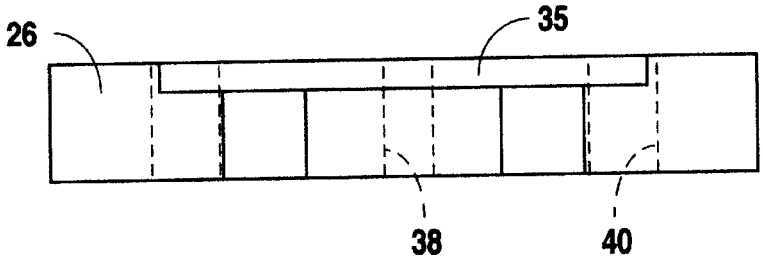
FIG. 4 is an elevational cross-section view of the adapter plate of the present invention taken along line 4—4 of FIG. 3.

FIG. 4 is a cross sectional view of the plate 26 taken along line 4—4 of FIG. 3. This figure shows the relationship of detent passages 38, threaded openings 40 and the recessed platform 35.

Figure 5:
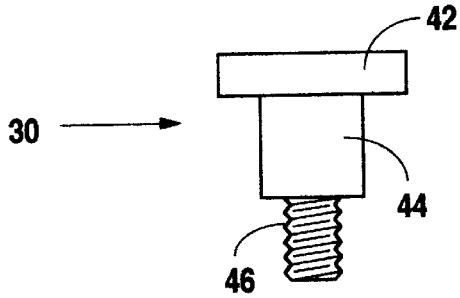
FIG. 5 is an elevational view of the plate stud of the present invention.

FIG. 5 illustrates an elevational view of the plate studs 30 of the present invention. Stud 30 has a head portion 42, a shoulder portion 44, and a threaded base portion 46. Shoulder 44 is larger in diameter than the threaded base to prevent the stud 30 from falling through the base 24.

Figure 6:
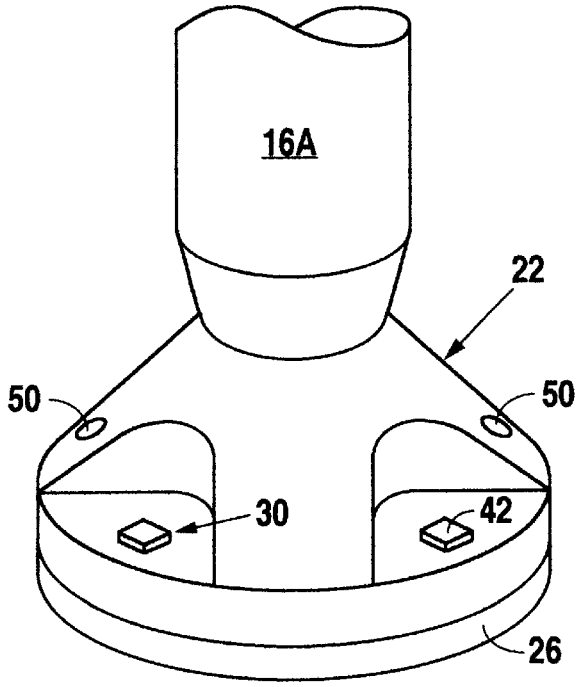
FIG. 6 is a top side perspective of the post, load cell and adapter plate.

FIG. 6 shows a perspective view of post 16A and load cell assembly 22 attached to plate 26 by bolts 30 having heads 42. Load cell detent passages 50 extend through cell 22 and align with passage 38 in the plate 26. When the post 16A is properly attached to base 24, passages 50 and 38 align with passage 70 in base 24 and will receive detent pin 71.

Figure 7:
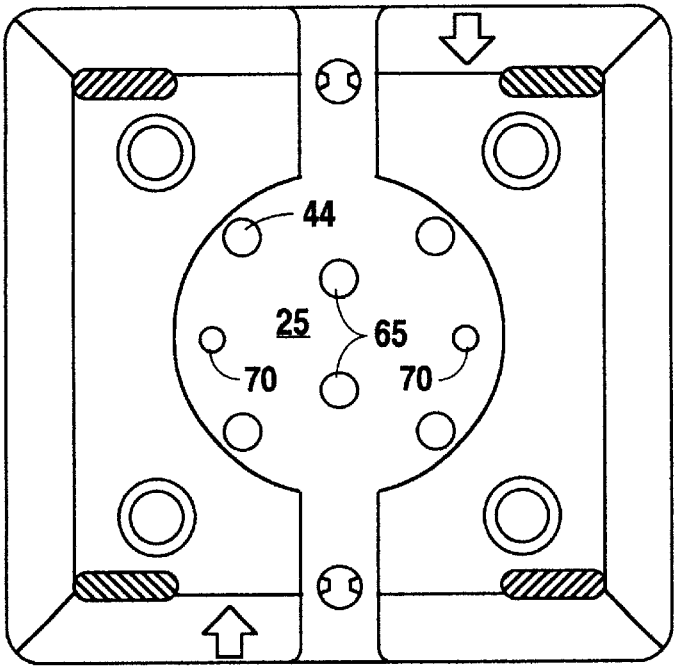
FIG. 7 is a top view of the fixed base of an embodiment of the present invention.

FIG. 7 is a top plan view of base 24 showing base detent passages 70, connector openings 44 (used when the present inventive adapter plate 26 is not installed), and stud receiving openings 65. Openings 65 are threaded to secure the threaded base 46 of the stud 30.

Figure 8:
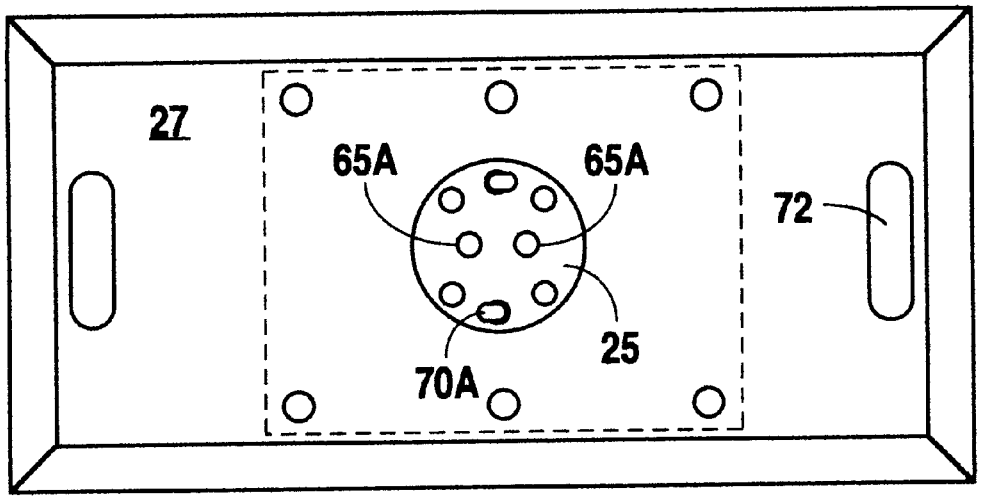
FIG. 8 is a top view of the portable base of an embodiment of the present invention.

FIG. 8 illustrates a top view of a portable base assembly 27 which may be used in combination with the present invention. The assembly may be lifted and carried by hand hold 72. Stud receiving openings 65A and base detent passages 70A may also be noted.

Figure 9:
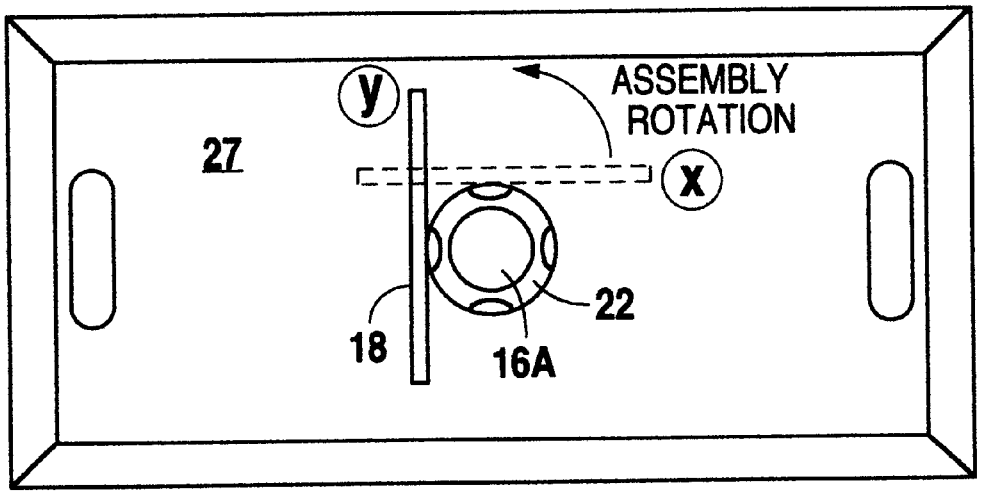
FIG. 9 is a top view of the portable base showing the positions for assembly.

FIG. 9 shows the method for the delineator system to be attached to the base 27. In position X the post 16A with the plate 26 attached to and beneath the load cell assembly 22 is positioned directly over the studs 30 attached to the base 27. The wide portion 80 (FIG. 3) of the slots 34 will allow the stud head 42 to easily fit through the slot 34 with the bottom of the head 42 above the recessed platform 35. In position Y the post and panel are rotated 90° and the narrow portion (82) of (FIG. 2) of the slot 34 will rotate along shoulder 44 beneath the stud head 42 thereby securing the delineator to the base.

Detent pins 71 are inserted through the aligned passages 50, 38 and 70 to prevent rotation of the connection and unintentional detachment of the delineator post from the base.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. A quick release delineator apparatus comprising:

a load cell assembly;

an adaptor plate affixed to a bottom side of said load cell assembly, said plate having slots in a recessed platform of said plate;

a delineator base member having plate studs extending upwardly from a load cell assembly receiving chamber in said delineator base member, said plate studs having head portions which cooperate with said slots to retain said load cell assembly to said base member upon rotation of said plate about said studs from a first position to a second position;

an alignment detent pin slidingly engagable through aligned passages in said load cell assembly, said plate, and said base member when said plate is in said second position.

2. The apparatus of claim 1 wherein said slots are radially aligned in said recessed platform of said plate, said slots having a wide portion sized to accept said stud head and a narrow portion narrower than said stud head.

3. The apparatus of claim 2 wherein said plate studs further comprise: a threaded distal section and a cylindrical shoulder portion, said shoulder portion having a diameter greater than said threaded distal section and said diameter less than the diameter of said head portion, said diameter of said shoulder portion approximately as wide as said narrow portion of said radially aligned slots.

4. The apparatus of claim 1 wherein said plate studs further comprise: a threaded distal section and a cylindrical shoulder portion, said shoulder portion having a diameter greater than said threaded distal section and said diameter less than the diameter of said head portion.

5. The apparatus of claim 1 wherein said delineator base member is fixed to a supporting surface.

6. The apparatus of claim 1 wherein said delineator base member is portable.

* * * * *